United States Patent [19]

Duclos

[11] Patent Number: 4,724,624

[45] Date of Patent: Feb. 16, 1988

[54] SLIP RESISTANT SHOE

[75] Inventor: Gary Duclos, Newburyport, Mass.

[73] Assignee: The Stride Rite Corporation, Cambridge, Mass.

[21] Appl. No.: 821,144

[22] Filed: Jan. 21, 1986

[51] Int. Cl.[4] ..... A43B 13/04; A43B 13/00

[52] U.S. Cl. ..... 36/116; 36/59 C; 36/59 R; D2/320

[58] Field of Search ..... 36/59 C, 59 R, 32 R, 36/25 R, 30 R, 116, 7.6, 7.7, 8.1, 113, 103, 7.3; D2/320

[56] References Cited

U.S. PATENT DOCUMENTS

| | | | |
|---|---|---|---|
| D. 112,429 | 12/1938 | Tebbutt | D2/320 |
| D. 201,952 | 8/1965 | Johns | D2/320 |
| D. 213,417 | 3/1969 | Dittmar, Jr. | D2/320 |
| D. 241,688 | 10/1976 | Johnson | D2/320 |
| D. 278,851 | 5/1985 | Austin | D2/320 |
| D. 280,355 | 9/1985 | Austin | D2/320 |
| D. 282,693 | 2/1986 | Brayer et al. | D2/320 |
| 4,266,349 | 5/1981 | Schmohl | 36/32 R |
| 4,281,467 | 8/1981 | Anderie | 36/59 C |
| 4,570,362 | 2/1986 | Vermonet | 36/59 C |

FOREIGN PATENT DOCUMENTS

| | | | |
|---|---|---|---|
| 1018202 | 12/1952 | France | 36/59 C |
| 848877 | 9/1960 | United Kingdom | 36/59 C |

*Primary Examiner*—Werner H. Schroeder
*Assistant Examiner*—Steven N. Meyers

[57] ABSTRACT

A shoe that includes an outsole having a plurality of gripping portions, the locus of the gripping portions defining a path extending from the outermost portion of the shoe below the small toe generally toward the ball of the foot at the large toe, with the portions contacting the ground sequentially along the path as the front portion of the outsole sets down. Also disclosed in providing a shoe outsole with a plurality of channels which have a first narrow region having a first width and an adjacent region having a larger width so as to permit deformable foreign matter such as food that collects in the first region to be discharged into the second region, which is sufficiently wider than the first region as to cause discharge of the matter.

15 Claims, 2 Drawing Figures

10
12
14
16
18
20
22
24
26
28
29
30
32
34
36
38
40
42
44
46
48
50
52
54
56

SLIP RESISTANT SHOE

BACKGROUND OF THE INVENTION

The invention relates to shoes, in particular shoes worn by workers in fast food restaurants and/or other areas where there is need to resist slipping on floors on which soft, slippery matter is deposited.

In fast food restaurants and similar areas, workers often move quickly, pivoting on their feet near the ball of the foot at the small toe. Because food and liquid typically are dropped and spilled on the floors, it is desirable to provide a shoe that helps protect against slippage during the pivoting motions.

SUMMARY OF THE INVENTION

In one aspect the invention features in general a shoe that includes an outsole having a plurality of gripping portions, the locus of the gripping portions defining a path extending from the outermost portion of the shoe below the small toe generally toward the ball of the foot at the large toe, with the portions contacting the ground sequentially along the path as the front portion of the outsole sets down. In preferred embodiments the path defines an arc about a point of pivoting located at the ball of the foot in the vicinity of the base of the small toe; the gripping portions are provided by discrete pads separated by channels in the surface of the outsole; the discrete pads are elongated on axes that extend generally radially from the pivot point; the outsole has a channel extending along its periphery; the outsole has channels defining arc shaped pads located about the pivot point; the gripping pads have edges between the flat contact regions and the transverse faces that extend into the outsole, some edges extending along the path and some edges extending in a radial direction from the pivot point, the corners at the junction of the edges providing good gripping action; and the outsole has a raised heel.

The invention features, in a second aspect, a shoe outsole which has a plurality of channels which have a first narrow region having a first width and an adjacent region having a larger width so as to permit deformable foreign matter such as food that collects in the first region to be discharged into the second region, which is sufficiently wider than the first region as to cause discharge of the matter. In preferred embodiments the channels are between discrete pads; the channels have two wider regions adjacent to a narrow region; the channels extend along radial axes from the region at the ball of the foot near the base of the small toe; the second region is tapered so that the section adjacent to the first region is wider than the section further away from the first region; the pads are arranged in pairs in such a manner that channels are located between the pads that comprise each pair; and the pads have rectangular shapes.

Other advantages and features of the invention will be apparent from the following description of a preferred embodiment thereof and from the claims.

DESCRIPTION OF THE PREFERRED EMBODIMENT

The drawings will be described first.

DRAWINGS

DETAILED DESCRIPTION

Figures 1, 2:
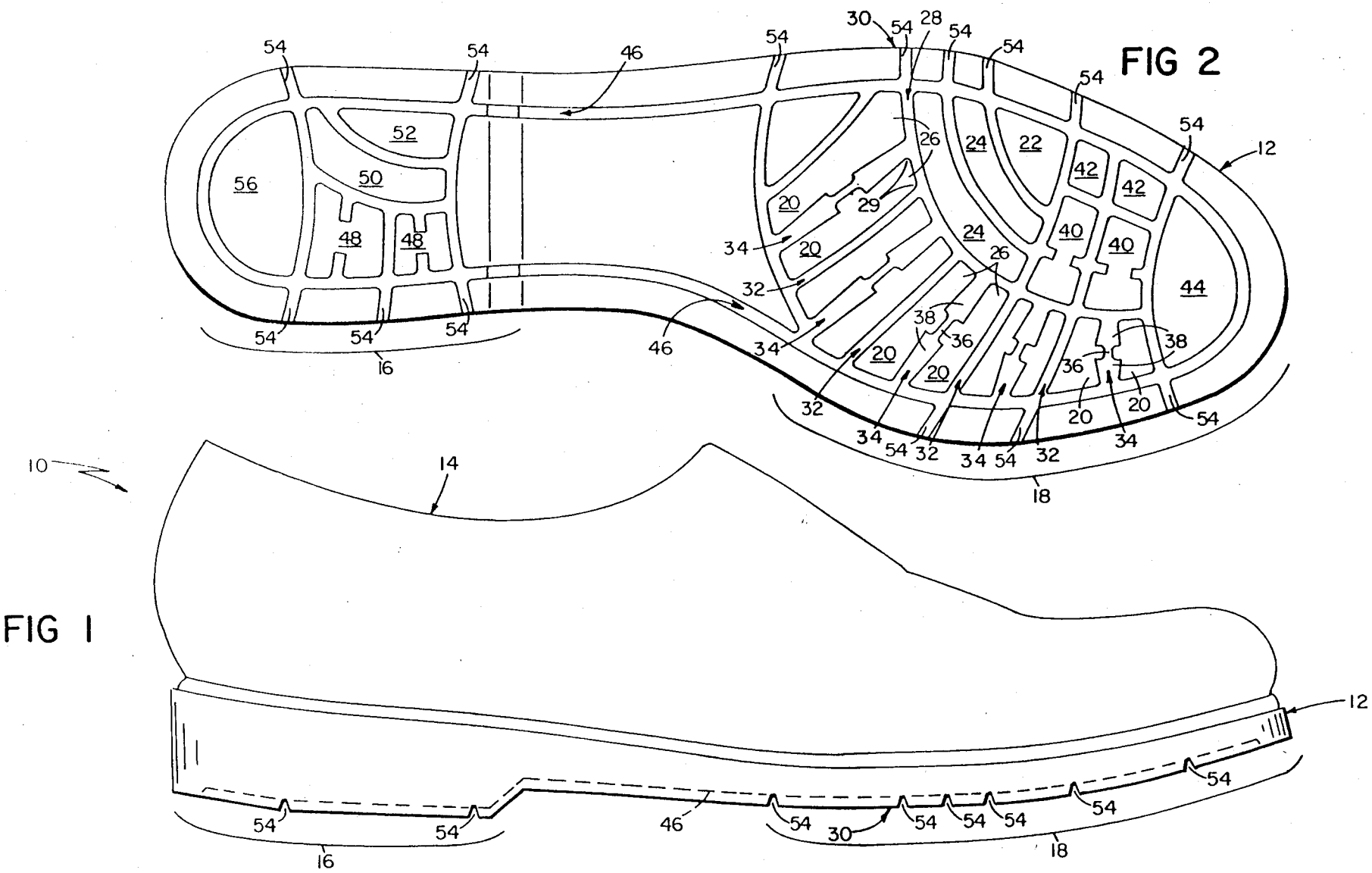
FIG. 1 is an elevation of a shoe according to the invention.
FIG. 2 is a bottom plan view of the outsole of the FIG. 1 shoe.

Referring to FIG. 1, there is shown shoe 10 having outsole 12 and upper portion 14. Outsole 12 is made of rubber (available under the trade designation Chem-Trac from Good Year) and has raised heeled portion 16 and front portion 18. Referring to FIG. 2, it is seen that the front portion 18 of the outsole has a plurality of elongated gripping pads 20 extending generally radially outward from a pivot point located on the ball of the foot in the vicinity of the base of the toe at triangular shaped pad 22. Between pad 22 and elongated pads 20 are two arc shaped pads 24.

Pads 20 are generally rectangularly shaped and have, at their radially inward ends adjacent to channel 28, gripping portions 26 located along the path that the front portion of the outsole follows as it sets down. Gripping pads 20 have corners 29 between edges of tne flat contact surfaces and the faces defining channel 28 and the transverse radial channels. Gripping pads 20 are arranged in pairs separated by channels 32. The pads in each pair are separated by a channel 34, which has a narrow section 36, located at approximately the middle of the length of the channel, and wider sections 38 on both sides of the narrow section. Channels 34 extend along opposite sides of a channel axis, and channels 34 expand along both sides of the channel axis in wider sections 38. There are five pairs of gripping pads 20. To the left of the two pairs of pads closest to the top of the foot are two H-shaped pads 40. To the left of pads 40 are two additional pads 42. At the top of the outsole is crescent shaped pad 44. Peripheral channel 46 extends along the periphery of the outsole at approximately 5/16 of an inch from the edge. Edge channels 54 extend from peripheral channel 46 to the outside of the outsole to permit discharge of liquid in the channels. Heel portion 16 has two H-shaped pads 48, curved rectangular pad 50, triangular pad 52, and crescent shaped pad 56.

Narrow channel sections 36 are approximately 1/16 inch in width; wide sections 38 are approximately 3/16 inch in width at their widest point. All other channels are approximately 3/32 inch in width. All channels are approximately 1/16 inch deep.

Operation

When shoe 10 is worn and subjected to quick movements of the user including pivoting, which typically occurs about a point near the ball of the foot at the small toe, outsole 12 makes and breaks contact along the path defined by the locus of gripping portions 26 which extends from the outermost portion of the shoe below the small toe to the ball of the foot at the large toe. As the outsole rolls onto the surface, gripping portions 26 along the path sequentially make contact with the surface. Corners 29 between edges of the flat contact surfaces and the faces defining channel 28 and the transverse radial channels provide particularly good resistance to slipping. The additional corners provided at the junctions of the narrow and wide sections of channels 34 provide even further resistance to slipping at the same time that they assist in discharge of food, as mentioned below. On wet, slippery surfaces, like those found on restaurant floors, this arrangement allows for better traction. Liquid is dispersed from the various internal channels to edge channels 54 and eventually is forced out the side of outsole 12.

The narrow neck feature of channel 34 enhances the ability of the outsole to shed bits of food, for example, french fries, that may be picked up from the floor of a restaurant. When a narrow neck section 36 receives a piece of food, the food is squeezed and discharged into adjacent wide sections 38. The flexing of the outsole during movement of the foot assists in forcing the food from a narrow neck section to a wider section. The squeezed food forced into the wide section tends to retain its narrow shape, making it easier to be released from the wide section. The movement of the squeezed food also tends to push the food that originally collects in the wide section, assisting in causing its release. The radial arrangement of pads 20 and grooves 34 between them causes the channels to open during flexing, also assisting in discharge of trapped food. The use of a narrow width channel next to a wider channel permits better discharge of food than when constant width channels are used.

OTHER EMBODIMENTS

Other embodiments are within the following claims.

What is claimed is:

1. A shoe comprising an outsole having a plurality of gripping portions, the locus of said portions defining a path extending from the outermost portion of the shoe below the small toe to the ball of the foot at the large toe, said portions contacting the ground sequentially along said path as the front portion of said outsole sets down, said path defining an arc about a pivot point region of pivoting located at the ball of the foot in the vicinity of the base of the small toe, said gripping portions being separated by elongated channels in the surface of said outsole, said channels extending generally radially from said pivot point region.

2. The shoe of claim 1, wherein said gripping portions are provided by discrete gripping pads separated by channels in the surface of said outsole.

3. The shoe of claim 3, wherein said discrete pads are elongated along axes that extend generally radially from said pivot point region.

4. The shoe of claim 2, wherein said outsole also has a peripheral channel extending along its periphery.

5. The shoe of claim 3, wherein said outsole also has channels defining arc shaped pads located between said pivot point region and said gripping pads.

6. The shoe of claim 3, wherein said pads have edges between flat contact regions and transverse faces extending into said outsole, first said edges extending generally along said path, and second said edges extending along radial axes from said pivot point region, said first and second edges meeting at corners that provide good gripping action.

7. The shoe of claim 1, wherein said outsole has a raised heel.

8. The shoe of claim 1, wherein said outsole has a plurality of channels which have a first narrow region having a first width and an adjacent second region having a larger width so as to permit matter that collects in said first region to be displaced into said second region, which is sufficiently wider as to cause discharge of said matter during flexing of said outsole.

9. A shoe comprising an outsole having a plurality of channels defined by side walls extending along opposite sides of channel axes, each said channel axis extending generally radially from a pivot point region of pivoting located on the ball of the foot in the vincinity of the base of the small toe, said channels each having a first narrow region having a first width and an adjacent second region having a larger width, said side walls in said second region each being spaced from its respective said axis by a larger distance than the distance from said axis to side walls in said first region, so as to permit matter that collects in said first region to be displaced into said second region, which is sufficiently wider as to cause discharge of said matter during flexing of said outsole.

10. The shoe of claim 10, wherein said channels are between discrete pads.

11. The shoe of claim 10, wherein said pads are arranged in pairs in such a manner that said channels are located between the pads that comprise each pair.

12. The shoe of claim 10, wherein said pads are rectangularly shaped and extend along radial axes from the region at the ball of the foot near the base of the small toe.

13. The shoe of claim 10, wherein said channels have two wider regions adjacent to said first region.

14. The sole of claim 9, wherein said second region is tapered so that the section adjacent to said first region is wider than the section further away from said first region.

15. The shoe of claim 9, wherein said outsole has a raised heel.

* * * * *